US012721395B1

(12) United States Patent
Russell

(10) Patent No.: US 12,721,395 B1
(45) **Date of Patent: *Sep. 1, 2026**

(54) HATS, INTERCHANGEABLE DECORATIVE CORDS AND METHODS OF INVISIBLY ATTACHING SAME

(71) Applicant: Robert C. Russell, Northbrook, IL (US)

(72) Inventor: Robert C. Russell, Northbrook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/333,624

(22) Filed: Sep. 19, 2025

(51) Int. Cl.

| | |
|---|---|
| ***A42B 1/004*** | (2021.01) |
| ***A42B 1/205*** | (2021.01) |
| ***A42C 5/00*** | (2006.01) |
| *A42B 1/0182* | (2021.01) |
| *A42B 7/00* | (2006.01) |

(52) U.S. Cl.
CPC ..... *A42B 1/004* (2013.01); *A42B 1/205* (2013.01); *A42C 5/00* (2013.01); *A42B 1/0182* (2021.01); *A42B 7/00* (2013.01)

(58) Field of Classification Search
CPC ..... A42B 1/004; A42B 1/205; A42B 1/0182; A42B 7/00; A42C 5/00
See application file for complete search history.

(56) References Cited

U.S. PATENT DOCUMENTS

| | | | | |
|---|---|---|---|---|
| 5,181,277 | A * | 1/1993 | Sherman | A42B 1/206 2/209.12 |
| 5,367,713 | A | 11/1994 | McCallum | |
| 5,450,629 | A | 9/1995 | Gilstrap | |
| 5,584,076 | A | 12/1996 | Armstrong | |
| 6,647,553 | B2 | 11/2003 | Hoyez | |
| 6,935,742 | B1 * | 8/2005 | Wilson, Sr. | G02C 3/02 351/158 |
| D715,032 | S | 10/2014 | Jones | |
| 9,554,612 | B2 * | 1/2017 | Hickey | A42B 1/0182 |
| 11,882,895 | B2 | 1/2024 | Bryan et al. | |
| 11,974,625 | B1 * | 5/2024 | Smith | A42B 1/24 |

(Continued)

FOREIGN PATENT DOCUMENTS

| | | | |
|---|---|---|---|
| CN | 103960808 | A | 8/2014 |
| CN | 112789233 | A | 5/2021 |

(Continued)

OTHER PUBLICATIONS

Badge Holder Elastic Cords. Accessed Dec. 22, 2023. https://www.nametag.com/lanyards/neck-cords/elastic-cord.php.

*Primary Examiner* — Katharine G Kane
(74) *Attorney, Agent, or Firm* — LESLEY A. WALLERSTEIN, LLC

(57) ABSTRACT

A hat has upper crown variations, circumferential lower crown variations, an interior surface of the upper and lower crown, an exterior surface of the upper and lower crown, a sweatband attached to substantially the entire circumference of the lower crown, forming a sweatband-lower crown seamline, brim variations, and a pair of holes in the sweatband-lower crown seamline. Decorative interchangeable cords each have two opposing ends and paired fastener variations capping each such end. Each end of the decorative interchangeable cord corresponds to and inserts into one hole in the sweatband-lower crown seamline, where it is fastened in place.

8 Claims, 9 Drawing Sheets

(56) References Cited

U.S. PATENT DOCUMENTS

| | | | | |
|---|---|---|---|---|
| 12,310,442 | B1 * | 5/2025 | Carre | A42B 1/004 |
| 12,426,655 | B1 * | 9/2025 | Russell | A42B 1/24 |
| 2009/0175482 | A1 * | 7/2009 | Crutcher | H04R 1/1033<br>381/376 |
| 2012/0030860 | A1 * | 2/2012 | Lovitz | A42B 1/004<br>2/209.13 |
| 2015/0150329 | A1 * | 6/2015 | Wilson | A42B 1/247<br>2/209.13 |
| 2017/0202294 | A1 * | 7/2017 | Hickey | A42B 7/00 |
| 2017/0258165 | A1 * | 9/2017 | Thornton | A42C 5/02 |
| 2019/0313727 | A1 * | 10/2019 | Acosta | A42C 5/02 |
| 2020/0214382 | A1 * | 7/2020 | Dann | A42B 1/225 |
| 2021/0259345 | A1 * | 8/2021 | Michaels | A42B 1/22 |
| 2022/0330643 | A1 * | 10/2022 | New | A41D 20/00 |
| 2024/0138506 | A1 * | 5/2024 | Fryer | A42B 1/02 |

FOREIGN PATENT DOCUMENTS

| | | | |
|---|---|---|---|
| KR | 880004036 | A | 6/1988 |
| KR | 20060092812 | A | 8/2006 |
| KR | 20100008342 | U | 1/2010 |

* cited by examiner

HATS, INTERCHANGEABLE DECORATIVE CORDS AND METHODS OF INVISIBLY ATTACHING SAME

CROSS REFERENCE TO RELATED APPLICATIONS

This application claims the benefit of U.S. Provisional Patent Application 63/624,127, filed Jan. 23, 2024, and U.S. Non-Provisional patent application Ser. No. 19/032,678, filed Jan. 21, 2025, the disclosures of both of which are incorporated herein by reference in their entireties.

STATEMENT OF GOVERNMENT INTEREST

Not Applicable.

JOINT RESEARCH AGREEMENT

Not Applicable.

SUMMARY OF THE INVENTION

A hat has upper crown variations, circumferential lower crown variations, an interior surface of the upper and lower crown, an exterior surface of the upper and lower crown, a sweatband attached to substantially the entire circumference of the lower crown, forming a sweatband-lower crown seamline, sweatband interior and exterior surfaces, brim variations, and a pair of holes in the sweatband-lower crown seamline. At least one decorative interchangeable cord has two opposing ends capped with a first fastening element from a variety of paired fasteners. Each capped end corresponds to one hole in the sweatband-lower crown seamline. The sweatband has an exterior facing the wearer's head when the sweatband is folded, and an interior facing the lower crown of the hat. We attach at least one second, cooperating, fastening element of the paired fastener to the interior of the sweatband. Most preferably, we attach this at least one second fastening element immediately adjacent each one of the holes without covering the holes. When the hat is worn, the at least one second fastening element is hidden within the sweatband.

The decorative interchangeable cord may have a round cross section like a rope, or a flat cross section like a ribbon or braid. The cord may be a textile, thermoplastic or non-woven material. Inserting each one of the capped ends of the decorative interchangeable cord from exterior of the hat into their corresponding holes and attaching them to their cooperating second fastening element positioned in the interior of the sweatband invisibly attaches the decorative cord to the hat. The decorative cord thus rests flat along the sweatband-lower crown seamline. We reverse these steps to remove or change the cord.

FIELD OF THE INVENTION

The invention is directed to hats with crown variations, brim variations, decorative cord variations and cord end cap variations and ways of interchangeably, yet invisibly, personalizing and customizing the hats with these decorative cords. People decorate hats with colored cords and ribbons for a variety of cultural, social, and personal reasons, which often stem from traditions, expressions of individuality, and a desire to signify achievement. Many schools, sports teams, and businesses have identifying colors.

Another reason people decorate hats with cords and ribbons is to express individuality, fashion sense, and personal style. For many, the hat is not just a uniform part of an outfit, but an opportunity to stand out or showcase personal interests. Customizing a hat with colors, patterns, or embellishments allows individuals to express their unique identities. Whether it's adding a ribbon to match a favorite color or using cords to highlight a special event, these decorations offer a chance to personalize what might otherwise be a simple or standard accessory.

Decorative cords also have symbolic meanings. For example, military personnel or members of specific organizations might decorate hats with these items as a way to show affiliation, rank, or honor. For instance, a military member might wear a ribbon to denote a particular medal or service, while a club or fraternity member might use cords to represent membership or achievements. The use of these decorations thus communicates affiliation and accomplishment, often serving as a mark of pride and solidarity with a group.

Decorating hats can serve as a form of creative expression. Many people enjoy the process of selecting, arranging, and adding cords, ribbons, or other embellishments to their hats, viewing it as an artistic activity. Whether for a graduation ceremony, a festival, or a special event, the decorative process can be an enjoyable, hands-on way for individuals to express their creativity.

In the past, such cords have been permanently attached to the hat. If you wanted a different colored or patterned cord, you would have to remove the stitching or glue, risking damage to either the hat, the cord, or both, or simply buy another hat with the cord you want. To date, no one has created a base hat or hat that permits a variety of cords to be attached and detached, used and re-used without either damaging the cord or the hat in the process. I have created such a system.

REFERENCE NUMERALS

1 Hat with attached interchangeable decorative cord
10 Hat
20 Interchangeable decorative cord
30 First fastening element of paired fastener
40 Sweatband
50 Brim
60 Sweatband-lower crown seamline
70 Hole
80 Lower crown
90 Second fastening element of paired fastener

DETAILED DESCRIPTION OF THE INVENTION

Figure 1:
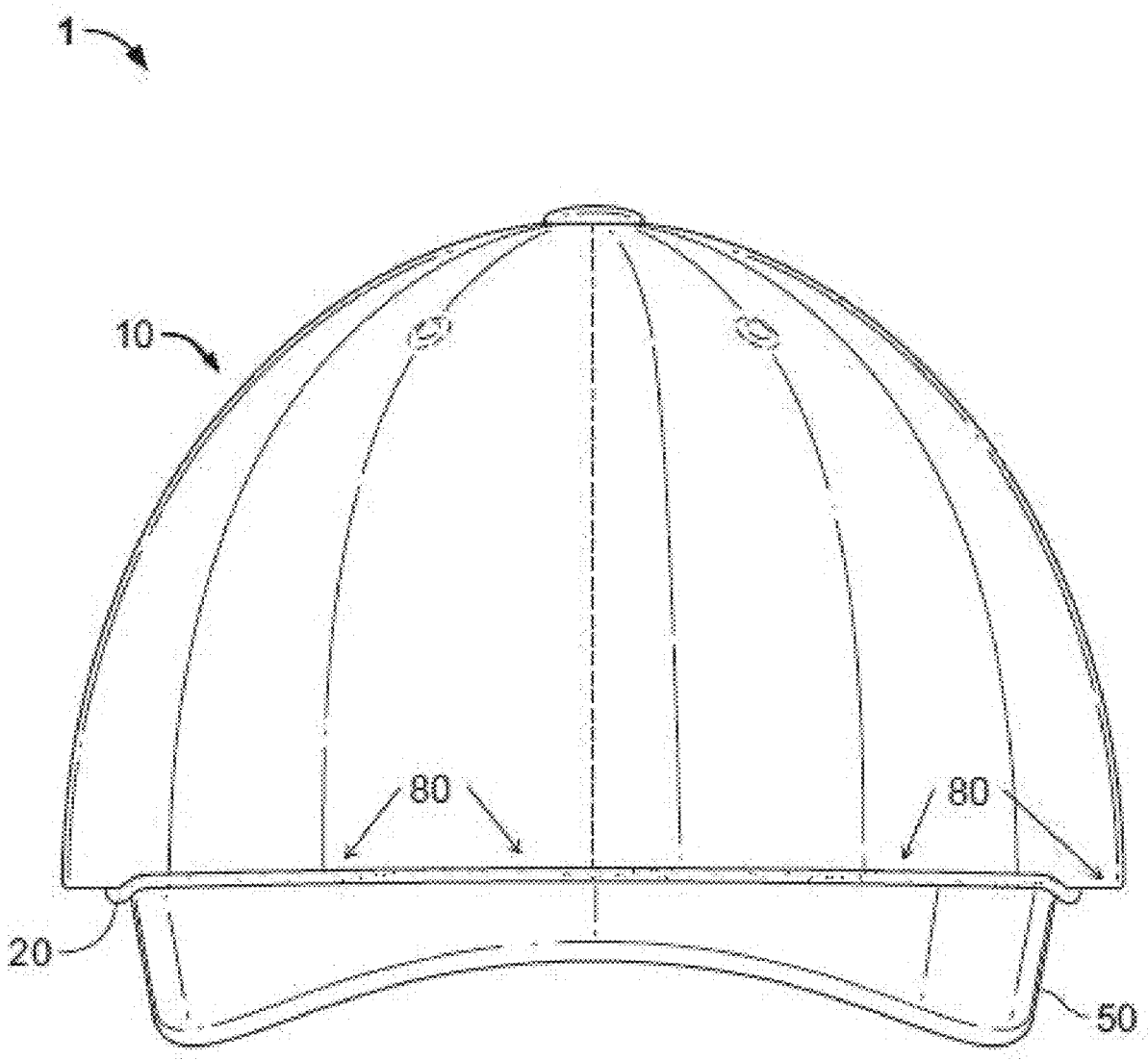
FIG. 1 is a front view of a hat and invisibly attached interchangeable decorative cord.

FIG. 1 is a front view of an embodiment of a hat and invisibly attached interchangeable decorative cord 1. This hat has an upper crown, a lower crown, a brim, and a sweatband. The upper crown and the lower crown have an interior surface, facing a wearer's head, and an exterior surface. The particular embodiment illustrated here, commonly known as a baseball hat or a trucker's hat, comprises four or more contoured panels seamed together and tapering to a top point. In this embodiment, the upper crown, not numbered, is closed at the top point. Where the panels meet at this top point is marked and secured by a button. The panels may comprise any combination of textile and mesh, woven or nonwoven material.

The hat features a lower crown 80, brim 50 and cord 20. Cord 20 rests on the seamline formed by joining brim 50 to lower crown 80. The hat may or may not have ventilation holes in the upper crown. Any such ventilation holes can be finished by sewn eyelets or grommets.

Figure 2:
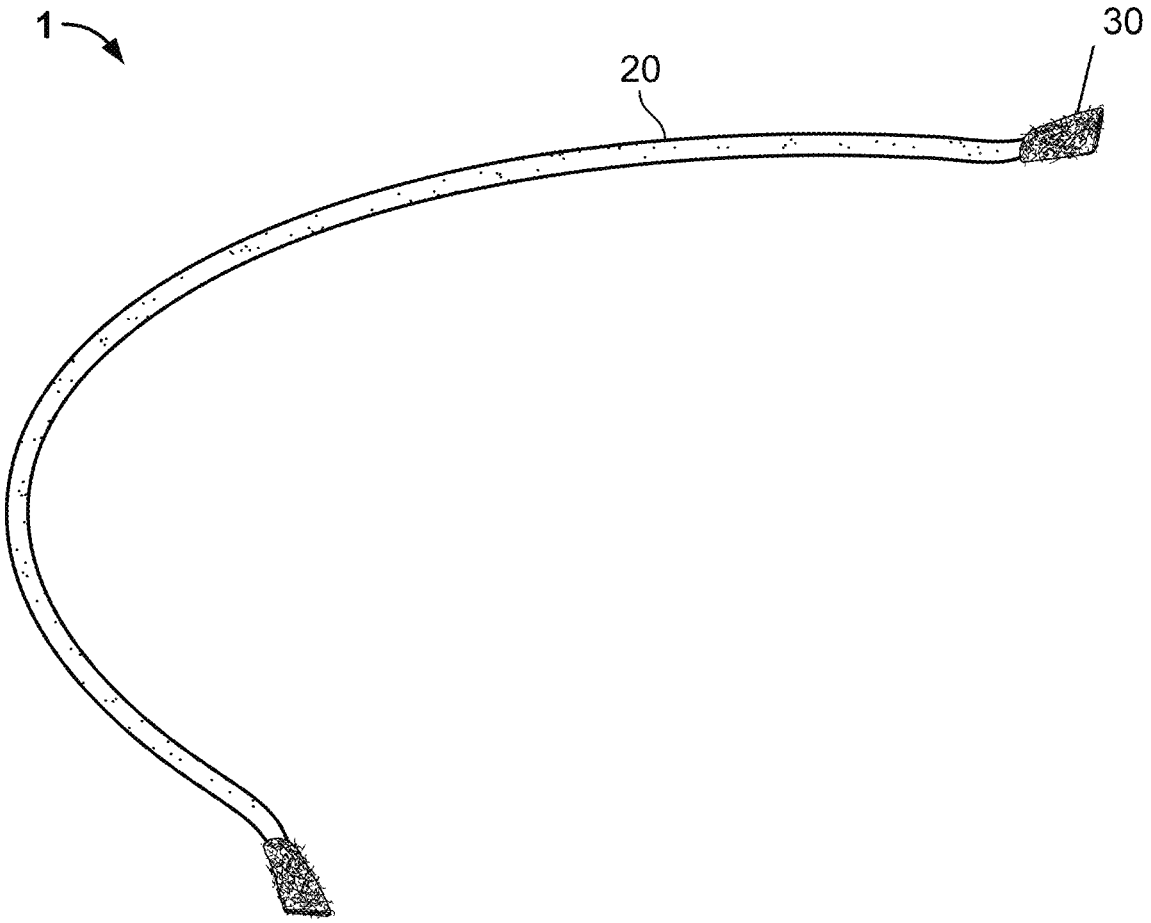
FIG. 2 is a perspective view of a first embodiment of the cord detached from the hat.
Figure 4:
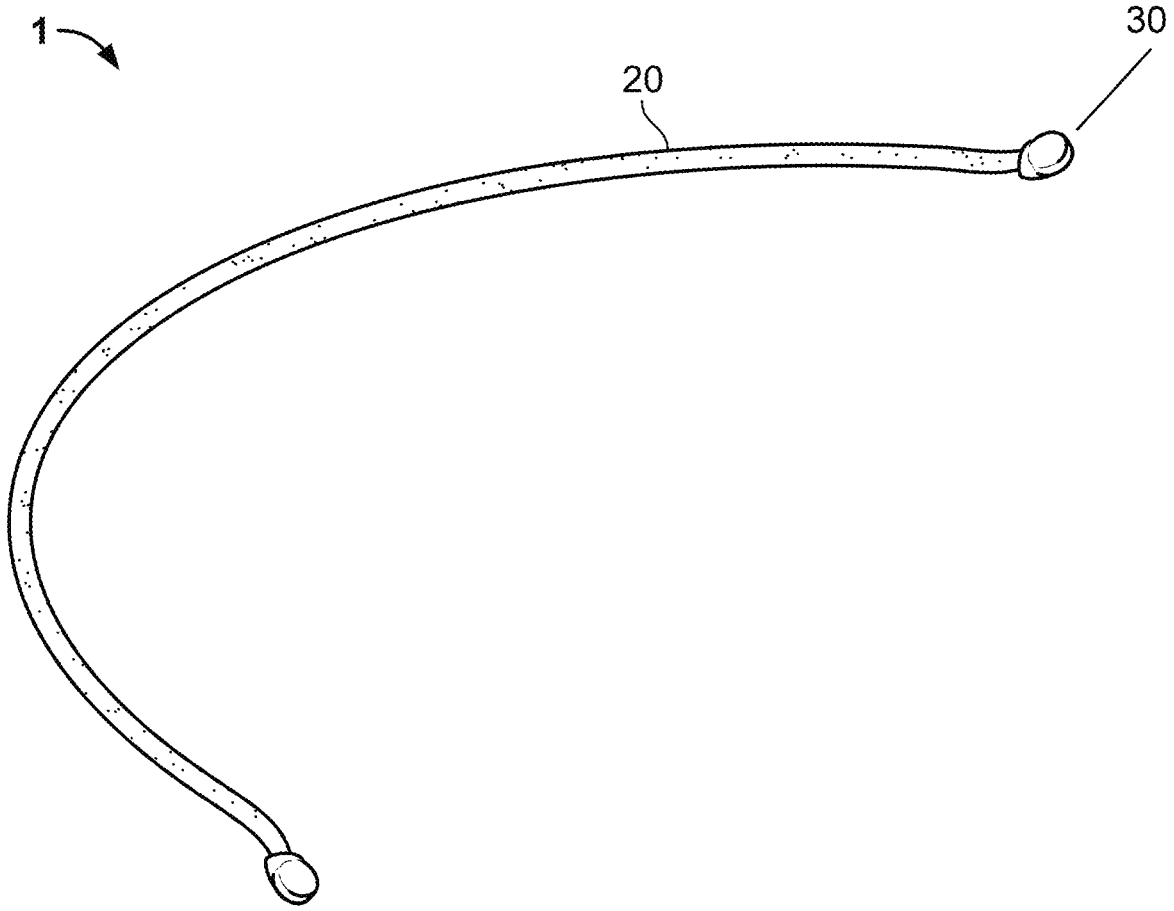
FIG. 4 is a perspective view of a second embodiment of the cord detached from the hat.
Figure 6:
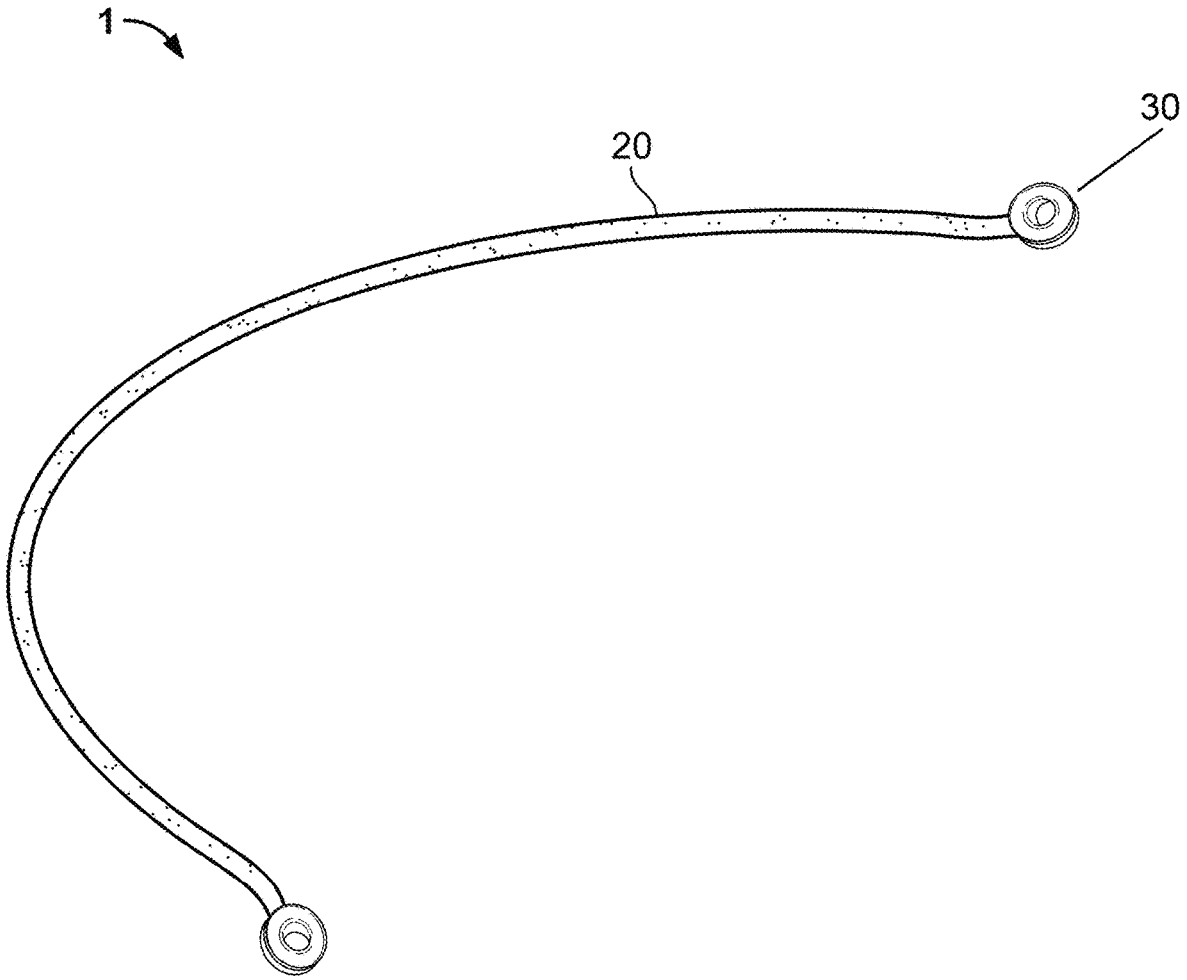
FIG. 6 is a perspective view of a third embodiment of the cord detached from the hat.
Figure 8:
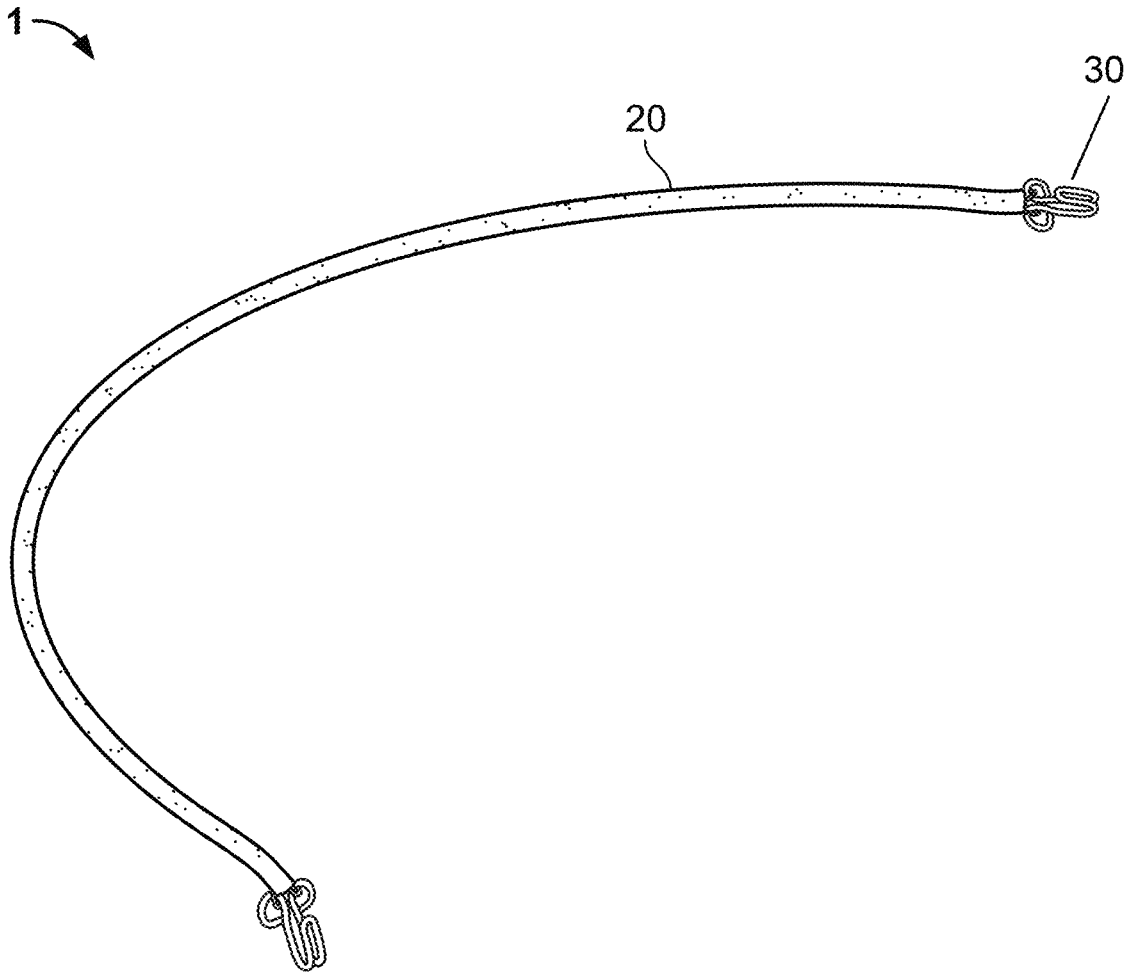
FIG. 8 is a perspective view of a fourth embodiment of the cord detached from the hat.

FIGS. 2, 4, 6 and 8 show cord 20 capped with a first fastening element 30 of a paired fastener. In FIG. 2, the first fastening element 30 is the loop element of a hook and loop tape fastener such as Velcro® brand. In FIG. 4, the first fastening element 30 is one of a pair of magnets. In FIG. 6, the first fastening element 30 is the female side of a snap fastener. The snap fastener may be plastic, metal or another material. In FIG. 8, the first fastening element 30 is a hook.

Figure 3:
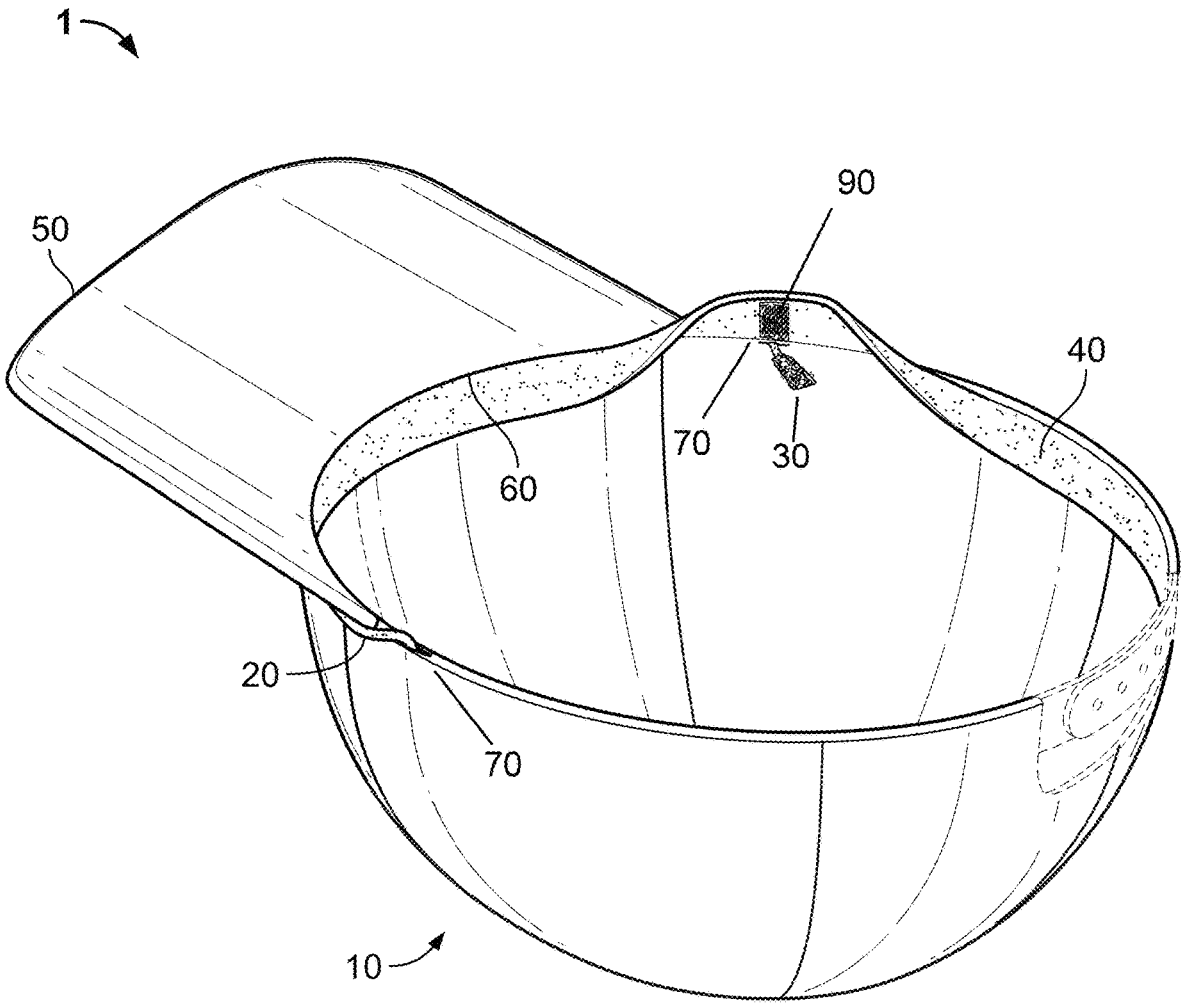
FIG. 3 is a bottom perspective view of FIG. 1, showing the first embodiment of the cord being attached to the hat.

FIG. 3 shows what this baseball/trucker hat looks like flipped upside down and a cord being inserted into each of holes 70. In this view, lower crown 80 of this specific hat forms a complete circle, except for a rear snapback closure. The system similarly works with other closure and size adjustment variations such as hook and loop tape, D-ring, elastic and buckle, as well as embodiments without a closure. The system works equally well for a hat without an upper crown and top point, as in a visor. It works in hats with a ponytail hole. Any hat that has a circumferential lower crown, a sweatband seamed to substantially the entire circumference of the lower crown, and a brim inserted into at least some portion of the sweatband-lower crown seamline will work.

Sweatband 40 attaches to the lower crown except for this snapback closure, substantially the entire circumference of the lower crown. Sweatband 40 is sewn to lower crown 80 to face the interior surface of the lower crown. This forms sweatband-lower crown seamline 60. A baseball/trucker hat such as this typically has a rigid, curved brim 50, also called a bill, which inserts into a front-facing portion of the sweatband-lower crown seamline. Other styles of brim and bill, not shown, are entirely possible.

Still referring to FIG. 3, we create a pair of spaced-apart holes 70 in the sweatband-lower crown seamline. The holes are specifically spaced apart the length of the cord. Each hole corresponds to one end of the cord. Holes 70 are not visible when the hat is worn. We reinforce and finish the holes with eyelets or an anti-fray chemical. In the embodiment shown, these holes are positioned between the brim and the rear of the hat. Cord 20 has a diameter and two opposing ends. Each of the two opposing ends of the cord are capped with a first fastening element 30 of a paired fastener. In this first embodiment, shown in FIG. 3, the paired fastener is hook and loop tape such as Velcro® brand. The loop element 30 caps the cord and the hook element 70 is attached to the interior of the sweatband.

Figure 5:
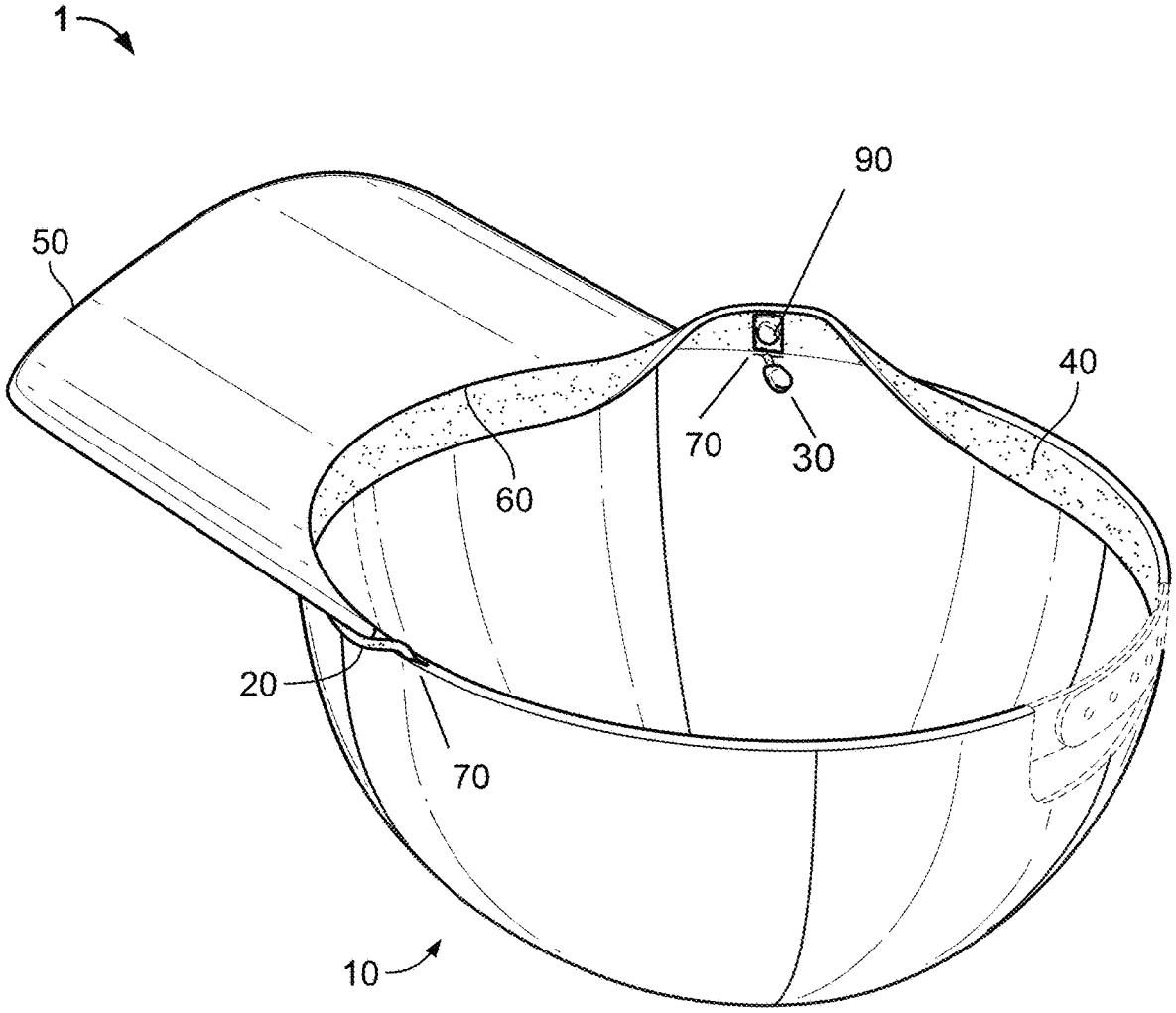
FIG. 5 is a bottom perspective view of FIG. 1, showing the second embodiment of the cord being attached to the hat.
Figure 7:
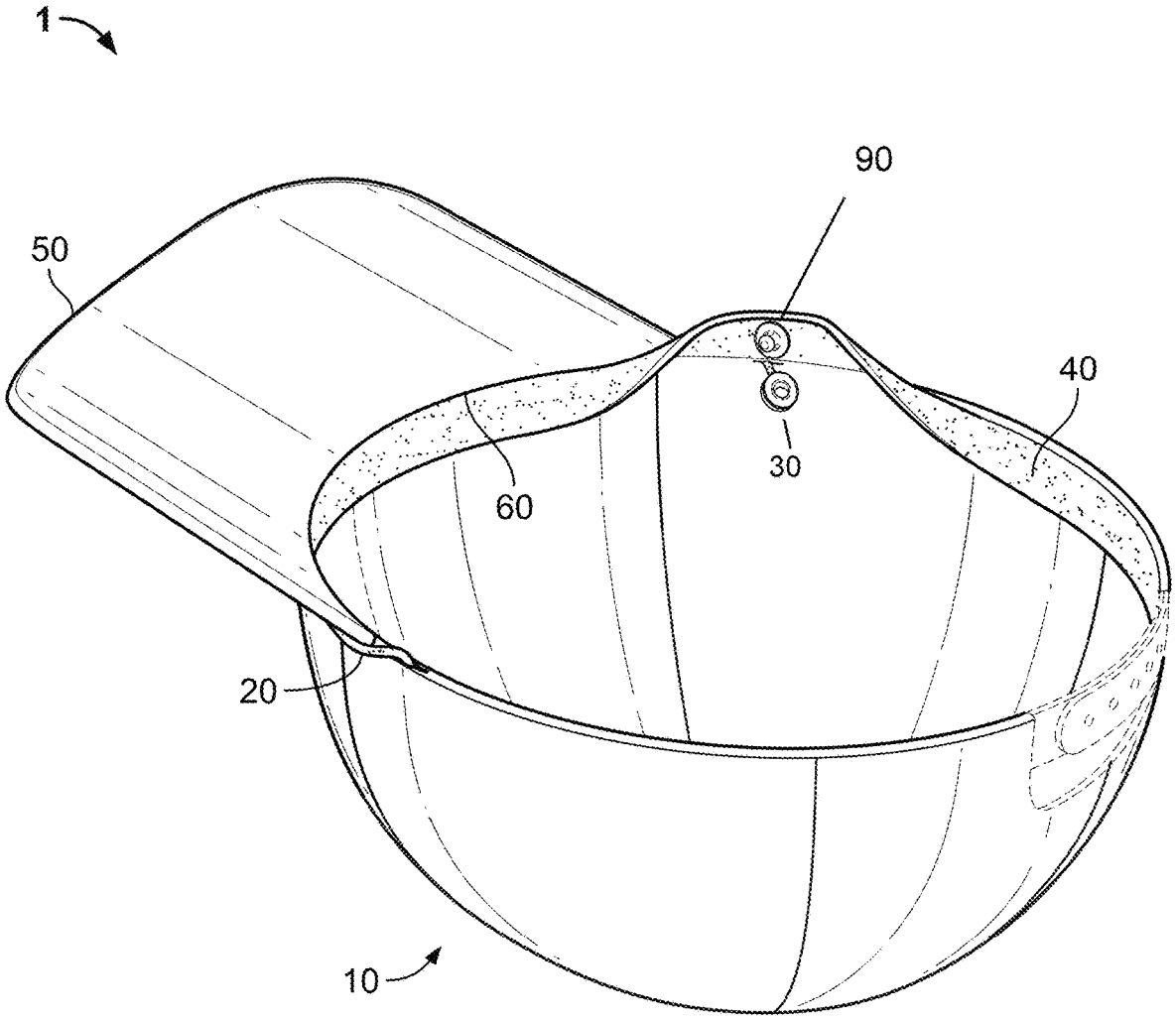
FIG. 7 is a bottom perspective view of FIG. 1, showing the third embodiment of the cord being attached to the hat.
Figure 9:
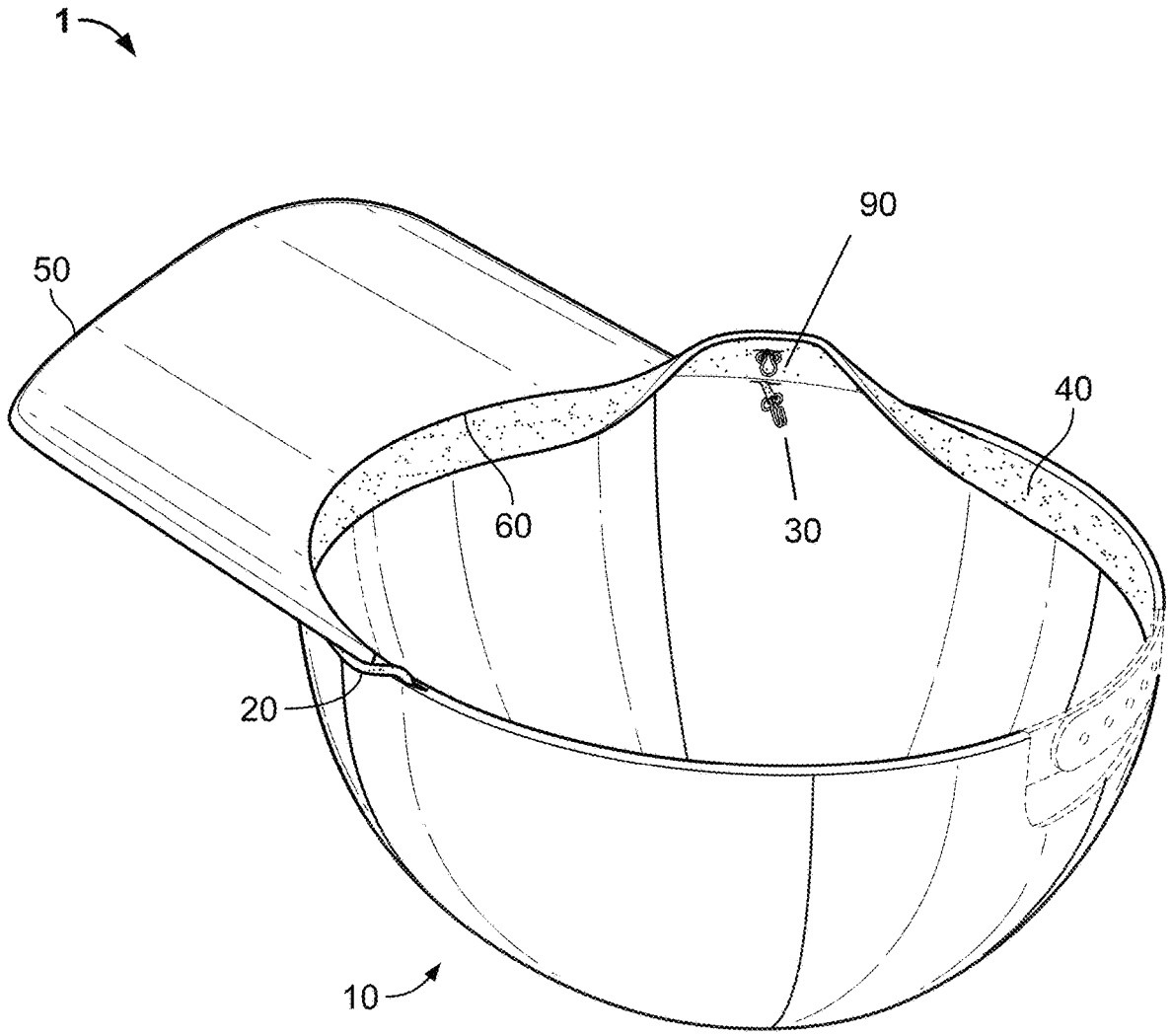
FIG. 9 is a bottom perspective view of FIG. 1, showing the fourth embodiment of the cord being attached to the hat.

FIGS. 5, 7 and 9 show a second, third and fourth embodiment wherein the paired fastener is a pair of magnets, snaps and a hook and eye, respectively. As was shown in FIG. 3, in each of these three other embodiments, we cap each of the two opposing ends of the interchangeable decorative cord with the first fastening element 30 and attach (by glue, thread or other means), the second fastening element 70 of the paired fastener to the interior of the sweatband. For all of these four embodiments, the paired fasteners are concealed from the outside of the hat when a person wears the hat.

For purposes of this patent application, when we use the word "cord," we mean not only a length of braided material with a circular cross section, but any decorative trim that has a length. Preferably, the cord is 28-31.5 cm long, which corresponds to the width of a typical baseball cap brim. The cord can be a length of braid that those in the industry often call a "rope" or "brim rope." The cord can also be a flat woven material such as twill tape, or grosgrain, satin, or other ribbon, to name a few. It can be a length of nonwoven material, or even thermoplastic such as gimp or lanyard. The drawings here illustrate the use of circular cross section "rope" for nonlimiting illustration purposes.

These proportions and dimensions allow a person to insert the first element 30 of the paired fastener into the hole, attach that first fastening element 30 to its cooperating second fastening element 70. This secures the cord in place between the sweatband and the interior of the lower crown, as shown in FIGS. 3, 5, 7 and 9. The wearer reverses these steps to remove the cord. These paired fasteners are not visible when the hat is worn, yet may not lie completely flat within and along the sweatband-lower crown seamline.

Although embodiments and examples of the invention have been shown and described, it is to be understood that various modifications, substitutions, and rearrangements of parts, components, steps, as well as other uses, shapes, construction, and design of this system can be made by those skilled in the art without departing from the novel spirit and scope of this invention.

I claim:

1. A method of attaching an interchangeable decorative cord to a hat having a circumferential lower crown, an exterior surface of the lower crown, an interior surface of the lower crown, a sweatband attached to substantially the entire circumference of the lower crown, along a sweatband-lower crown seamline, and a brim inserted into the sweatband-lower crown seamline, comprising the steps of:

a. capping each of the two opposing ends of the cord with a first fastening element of a paired fastener;

b. opening the sweatband, thereby exposing the sweatband-lower crown seamline;

c. inserting each capped end of the cord into a corresponding hole in the sweatband-lower crown seamline, from the exterior surface of the lower crown toward the interior surface of the lower crown;

d. attaching each such first fastening element to its cooperating second fastening element positioned on the interior of the sweatband; and e. closing the sweatband, thereby enclosing the paired fastener between the sweatband and the interior surface of the lower crown.

2. A hat assembly, comprising:

a. a hat with a circumferential lower crown;

b. an exterior surface of the lower crown;

c. an interior surface of the lower crown;

d. a sweatband attached to substantially the entire circumference of the lower crown, thereby creating a sweatband-lower crown seamline, this sweatband having an interior facing the hat and an exterior facing the wearer;

e. at least one interchangeable decorative cord with a length and a first fastening element of a paired fastener capping each opposing end of the cord;

f. a pair of holes in the sweatband-lower crown seamline, these holes spaced apart the length of the interchangeable decorative cord;

g. at least one second and cooperating fastening element of the paired fastener positioned on and attached to the sweatband interior; and h. a brim inserted in the sweatband-lower crown seamline.

3. The hat assembly of claim 2, wherein the hat also has an upper crown.

4. The hat assembly of claim 2, wherein the hat has a back closure.

5. The hat assembly of claim 4, wherein the back closure is selected from the group consisting of snapback, hook and loop tape, buckle and elastic.

6. The hat assembly of claim 2, wherein the paired fastener is selected from the group consisting of hook and loop tape, magnets, snaps and a hook and eye.

7. A hat, comprising:

a circumferential lower crown;

a sweatband attached to the lower crown along a sweatband-lower crown seamline extending around a circumference of the lower crown, the sweatband having an interior surface facing the lower crown and an exterior surface configured to face a wearer's head;

a brim inserted in the sweatband-lower crown seamline;

holes in the sweatband-lower crown seamline that are spaced apart along the sweatband-lower crown seamline;

an interchangeable decorative cord including first fastening elements of a paired fastener attached to opposite ends thereof; and cooperating second fastening elements attached to the interior surface of the sweatband, wherein each of the first fastening elements is dimensioned to pass through a corresponding one of the holes and releasably attach to a cooperating second fastening elements.

8. The hat of claim 7, wherein the sweatband covers the first and second fastening elements.

* * * * *